US006010300A

United States Patent [19]

Seefeldt

[11] Patent Number: 6,010,300

[45] Date of Patent: Jan. 4, 2000

[54] STACKER

[75] Inventor: Joachim Seefeldt, Neuffen, Germany

[73] Assignee: bielomatik Leuze GmbH & Co., Germany

[21] Appl. No.: 09/032,705

[22] Filed: Feb. 27, 1998

[30] Foreign Application Priority Data

Feb. 28, 1997 [DE] Germany ..... 197 08 125

[51] Int. Cl.[7] ..... B65H 31/30

[52] U.S. Cl. ..... 414/790.3; 414/790.8; 414/794.4

[58] Field of Search ..... 414/790.3, 789, 414/789.1, 790.8, 794.4

[56] References Cited

U.S. PATENT DOCUMENTS

| | | | |
|---|---|---|---|
| 2,672,079 | 3/1954 | Chandler . | |
| 3,379,320 | 4/1968 | Loach et al. | 414/790.3 |
| 4,367,997 | 1/1983 | Schweingruber | 414/790.3 |
| 4,878,659 | 11/1989 | Besemann . | |
| 5,000,657 | 3/1991 | Gunther, Jr. . | |
| 5,014,974 | 5/1991 | Jones et al. | 414/790.8 |
| 5,145,159 | 9/1992 | Vits | 414/790.8 |
| 5,261,522 | 11/1993 | Guttinger et al. | 414/790.3 |
| 5,322,272 | 6/1994 | Benz et al. | 414/790.8 |
| 5,368,288 | 11/1994 | Phillip et al. | 414/790.8 |
| 5,433,429 | 7/1995 | Muller | 414/790.8 |
| 5,433,582 | 7/1995 | Medina | 414/790.3 |

FOREIGN PATENT DOCUMENTS

| | | |
|---|---|---|
| 0 113 286 | 7/1984 | European Pat. Off. . |
| 0 270 943 | 6/1988 | European Pat. Off. . |
| 448732 | 10/1991 | European Pat. Off. . |
| 2 454 990 | 11/1980 | France . |
| 2 538 362 | 6/1984 | France . |
| 1 217 772 | 10/1959 | Germany . |
| 1 217 772 | 5/1966 | Germany . |
| 27 15 705 | 11/1977 | Germany . |
| 28 42 116 | 4/1979 | Germany . |
| 35 07 009 | 9/1985 | Germany . |
| 35 33 628 | 4/1986 | Germany . |
| WO 88/00921 | 3/1988 | WIPO . |

*Primary Examiner*—Robert P. Olszewski
*Assistant Examiner*—Gregory A. Morse
*Attorney, Agent, or Firm*—Quarles & Brady

[57] ABSTRACT

A stack (7) piled from a feed conveyor (3) can be transferred with stack definitions (15, 16) which can be lowered and optionally shifted in opposite directions to the left or right onto an exit conveyor (4 or 5), whilst the stack plies (6) continuing to be fed are intercepted by an auxiliary means (40, 50) and lowered onto the stack support (8) following return of the stack definition (15, 16) into the stacking position, as a result of which very simple and gentle exit transport of the stacks (7) materializes at high working speed.

29 Claims, 4 Drawing Sheets

STACKER

BACKGROUND OF THE INVENTION

1. Field of the Invention

The invention relates to a stacker with which stacks of ply material, more particularly sheets of paper or the like can be received or piled, to be then shipped and, where necessary, packaged as cubic blocks. Expediently the stacker is located at the output of a paper processing machine, the cross-cutter of which parts the individual plies from the web of material arriving directly from a reel storage, transposes them into a shingled ply stream and thus presents them to the stacker.

2. Description of the Background

In transferring the piled stack from the stacking station to an exit conveyor care must be taken to ensure that all single plies or sheets of paper remain congruent. If tongs engagingly pulling the stack are provided as the conveying member, the result is relatively complicated technically and bulky. In addition to this such a configuration is susceptible to causing trouble and relatively long downtime materializes when feeding conveyance of the stack plies needs to be interrupted until exit of the stack from the stacking station has been fully completed.

OBJECTS OF THE INVENTION

The invention is based on the object of defining a stacker which obviates the disadvantages of known configurations or of the kind as described and which more particularly by a simple configuration and with minimum control of the movement sequences permits a high working speed.

SUMMARY OF THE INVENTION

In accordance with the invention means are provided to push the stack out of the stacking station up to the exit conveyor in one go. The stack support on which the stack plies are piled directly and without using a pallet can be located at a constant height during operation, i.e. from placement of the lowermost sheet up to placement of the uppermost sheet, merely lateral stack definitions being needed to be adjusted in height relative to the stack support in forming stacks differing in height.

Although a separate pusher can be provided, it is expedient when the pusher is formed directly by such a stack definition so that it is already in contact with the edge surfaces areas of all stack plies on commencement of the stack being piled, it merely requiring to execute the horizontal pushing movement on completion of piling. When the pusher is located opposite a further stack definition of the same kind for the stack edge located parallel thereto, this definition is expediently lowerable from its working position directly downwards to below the stack support so that it does not come into contact therewith when the stack is pushed.

It is particularly of advantage when the stacking station is located between two exit conveyors so that both opposing stack definitions are provided both as pushers as well as being optionally lowerable in the way as described. The stack definition at the front as viewed in the pushing direction is then lowered each time the rear definition remains stationary as the pusher, it executing the pushing movement together with the other. The arrangement between two exit conveyors is also suitable for other conveying members, for example, for the cited conveyor tongs since particularly short transfer or pusher travel materialize and for attaining an exit conveyor located further away, one located nearer is not required to run over with the stack. In addition the stack support does not need to be continually lowered on piling the stack, instead the bottom of the stack can remain at the height at which it was located during piling of the stack, until the stack is transferred to the exit conveyor. The two exit conveyors can be caused to approach each other in the exit direction outside of the stacking station via s-shaped curved sections so that their runout ends are then located directly juxtaposed and are thus readily accessible or can merge in the same packaging machine where the stack is totally wrapped with paper.

The feed direction of the stack plies is located expediently parallel to the transfer direction of the transfer conveyor while the exit direction is located at right angles transversely thereto, but likewise horizontal.

To avoid having to interrupt the feed during movement of the stack out of the stacking station, an auxiliary means including a retainer and/or a support is provided above the stack support and the completed stack. This auxiliary retainer or support permits travel parallel to the feed and transfer direction from outside of the stack base thereover and temporarily receiving the stack plies fed further or permits to hold back the sheet while being fed. As soon as the conveying members are again in the stacking position the auxiliary member can be retracted, the few stack plies deposited or jammed thereon as a flat stack being skimmed off or again fed to drop onto the stack support. After this, all stack plies supplied further are released one after the other spaced away above the stack from the feed conveyor so that they can drop by their own weight onto the stack.

For facilitated maintenance the feed conveyor and the auxiliary members can be each transposed independently of the other from their position above the movement path of the stack into a servicing position remote therefrom, for example, by being swivable upwards or laterally out of the way. So that the stack plies are piled congruently, vibrators are provided which cause the stack support and the stack definitions or the pusher in each case to vibrate with an amplitude of approximately one millimeter throughout the complete piling procedure.

Irrespective of the remaining configuration the exit conveyor comprises means for producing differing friction values between the exit support and the bottom of the stack or for varying these frictions values over the supporting width of the stack. For example, the exit support may be perforated and connected to an air conveyor so that juxtaposed width portions each receive independently of the other a flow of either suction air or compressed air. While the stack is shifted onto the exit support compressed air is expediently blown against the underside. When a conveyor belt is provided as the driven exit conveyor member the belt is expediently narrower than the stack and during the exit movement the bottom of the stack is drawn against the exit support of this conveying member by suction air while lateral stack portions located lateral adjacent thereto run on sliding surfaces and their friction is reduced to a minimum by directing a flow of compressed air against the sliding underside.

These and further features are evident not only from the claims but also from the description and the drawings, each of the individual features being achieved by themselves or severally in the form of subcombinations in one embodiment of the invention and in other fields and may represent advantageous aspects as well as being patentable in their own right, for which protection is sought in the present.

BRIEF DESCRIPTION OF THE DRAWINGS

Example embodiments of the invention are explained in more detail in the following and illustrated in the drawings in which.

DESCRIPTION OF THE PREFERRED EMBODIMENTS

Figures 1, 1A:
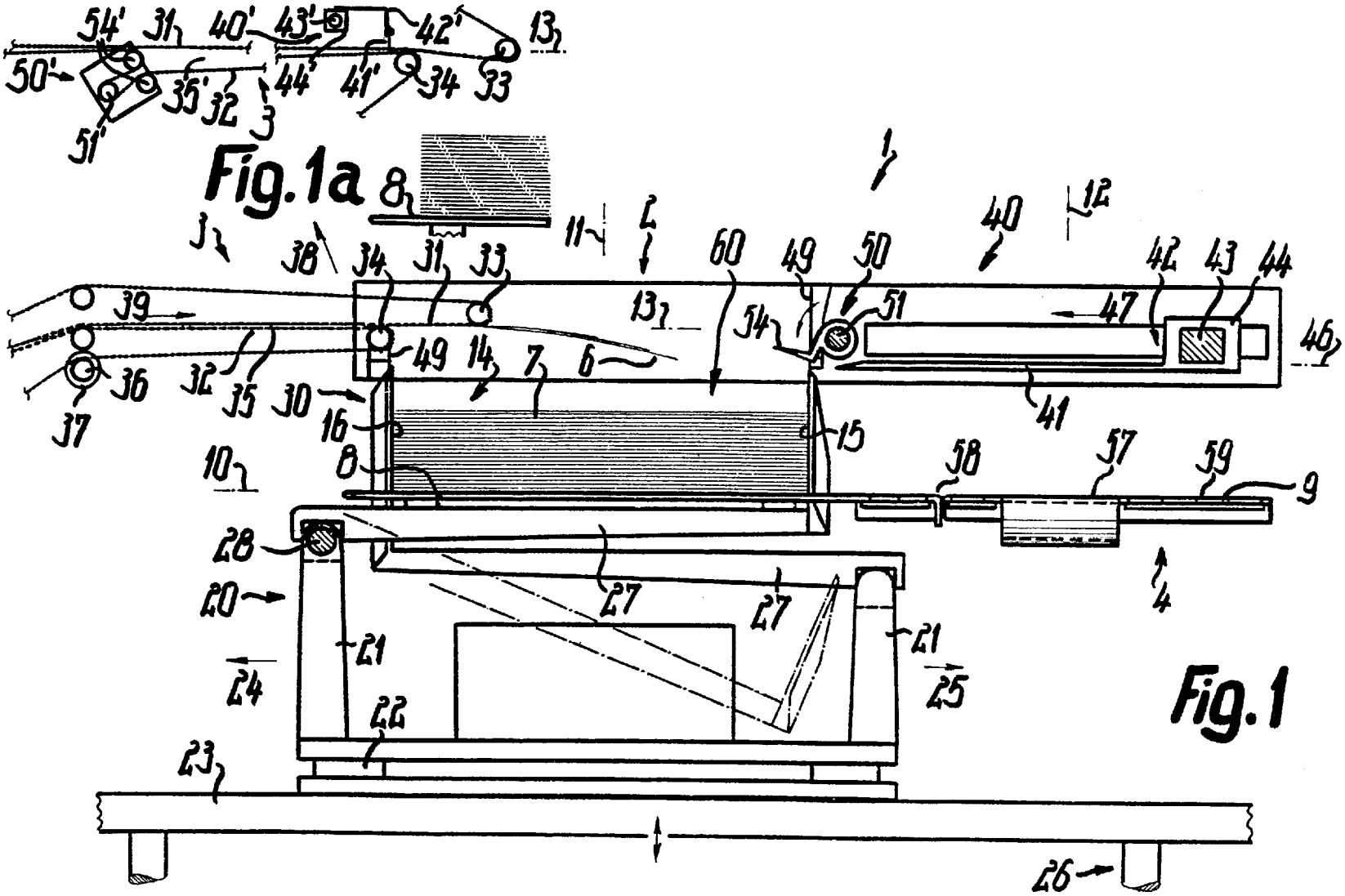
FIG. 1 is a view of the stacker in accordance with the invention as viewed from the side.
FIG. 1*a* is a further embodiment of auxiliary means shown in FIG. 1.

The stacker 1 comprises a stacking station 2 into which the stack plies 6 are fed in a shingled stream by a feed conveyor 3 located thereabove and in which they are piled into a stack 7. After piling, the stack 7 is transferred by a transfer conveyor 60 to an exit conveyor 4 or 5 which transports the stack away from the stacker 1.

The stacking station 2 comprises as a stack support 8 a stationary, dimensionally rigid table on the upper supporting surface area of which the lowermost stack ply 6 is directly deposited and on which in being transferred to the exit conveyor 4 or 5 this lowermost ply 6 slides as well as on the upperside of the exit support 9. These upper sides or supporting and sliding surface areas are located in a common horizontal plane 10. At right angles to the conveying or transfer direction and to the plane 10 the station 2 defines a center plane 11 and the exit conveyor 4 or 5 a center plane 12. Spaced away above and parallel to the plane 10 the feed conveyor 3 defines a feed plane 13 in which the stack plies 6 always arrive spaced away above the top of the stack 7 horizontal and at right angles transversely to the plane 11 before being released from the feed conveyor 3 and allowed to sink onto the top of the stack 7.

A separate stacking chute 14 is formed for each stack 7 in the stacking station 2, a plurality of separate chutes 14 being arranged juxtaposed parallel to the planes 10, 11 for feeding by a common or separate feed conveyors 3, the stacks 7 being transferred to a common exit conveyor 4, however, each vertical chute 14 is defined on all four sides, namely by dimensionally stable chute definitions 15 to 18 of which the definitions 15, 16 on both sides of the center plane 11 are located opposite each other, while the other chute definitions 17, 18 are located at right angles to the latter opposite each ot her and each formed by a thin, plate-type wall.

Adjacent chutes 14 or stacks 7 are separated from each other in each case by only one wall 18. The chute definitions 15, 16 are formed by rod-type arms jutting upwards beyond the upper side of the supports 8, 9, these arms emanating from this upper side or passing through the stack support 8 in the region of passage openings 19 such as slots. Each definition 15 or 16 is formed by two arms located spaced away from each other more than from the adjacent wall 17 and 18 respectively. For each arm a separate closely fitting passage opening 19 is provided defined continually over its full periphery and fully passing through the support 8 and 9 respectively.

The lower ends of the definition arms 15, 16 are arranged on a car or slider 20 which in the position as shown in FIG. 1 forms mounting columns 21 jutting upwards on both sides of the plane 11, at the top ends of which the definitions 15, 16 are swivably mounted. The mounting columns 21 are secured by vibrating mounts 22 to the part of the slider which is reciprocatingly mounted in directions 24, 25 on rails 23 at right angles transversely to the plane 11, namely horizontal by a drive (not shown), The car 20 or rail 23 is shiftable by means of a reciprocating device 26 at right angles transversely to the plane 10, as a result of which the height of the parts of the definitions 15, 16 jutting upwards beyond the plane 10 can be infinitely varied.

Each definition 15 or 16 forms a leg of a two-armed angle lever, the other arm 27 of which is oriented below the supports 8, 9 parallel to the direction 24, 25 to the opposite definition 16 and 15 respectively and which is loaded only by tension in the transfer movement to be described later. The end of the arm 27 remote from the corresponding definition 15 or 16 is swivably mounted at the upper end of the corresponding column 21. For this purpose the columns 21 each carry a shaft 28 rotatively mounted on the columns 21 and to which the angle arms 15, 27 or 16, 27 are secured so that each definition 15 or 16 is swivable about the axis 29 of the corresponding shaft 28 through an angle of arc of max. 40°. Accordingly, each definition 15 or 16 is swivable totally below the support 8 and 9 respectively as is indicated by the dot-dashed line of the definition 15 in FIG. 1. In this case the axes 29 are located further removed from the center plane 11 than the chute definitions 15, 16, namely as viewed from above in FIG. 2 outside of the chute so that the arms 16, 27 are able to pass through between the arms 15, 27.

Instead of (as shown) providing the swivel axis 29 on the side of the plane 11 other than that of the corresponding definition 15 and 16 respectively in each case, it could also be located on the same side. Each of the shafts 28, 29 is drivingly connected to a positioning motor (not shown) so that each can be rotated independently of the other. In the present case one full-length shaft 28 is provided in common for all definitions 15 and 16 of all chutes 14. However, it is just as conceivable to provide separate shafts having separate positioning motors for the definitions 15, 16 of each chute 14 so that they can be swivelled independently of each other. The two axes 29 may be located at the same level or at differing levels.

When a definition 15 or 16 is swivelled downwards, it instantly lifts off from the corresponding stack edge in a shallow arc so that the chute 14 is then open at the corresponding side and the other definition 16 or 15 can be effective as the pusher 30. The car 20 is then pushed to the right in direction 25 as shown in FIG. 1 so that the arms 16 of the pusher 30 shift the stack 7 at first only onto the support 8, and then onto both supports 8, 9 before finally shifting it slidingly in the direction 25 only onto the support 9, until the stack 7 formerly located symmetrically to the plane 11 is then located symmetrically to the plane 12. In this action the arms 16 of the pusher run in closely fitting slots or passages 18 by which they are keenly guided since the passages 19 extend beyond the region of the chute 14 up into the region of the support 9. The car 20 is then travelled in the opposite direction 24 again at right angles transversely to the planes 11, 12 into the starting position, namely in the s tacking station 2, the definition 15 again transposed upwards in to its definition position and the next stack 7 piled. If the stack 7 is to be transported out of the station 2 in the opposite direction 24 the definition 16 is first lowered in the way as already described and the stack 7 transported out of th e chute region by the definition 15 being the pusher.

FIG. 1 depicts only a single exit conveyor 4 on one side of the chute 14, i.e. on the side remote from the feed conveyor 3. However, as shown in FIGS. 4 to 7 another exit conveyor 5 the same as the exit conveyor 4 may also be provided on the other side level with as well as spaced away below the feed conveyor 3. In this case the stacking station 2 is located with the chute 14 between the exit conveyors 4, 5 so that the spacing between the planes 11, 12 for both exit conveyors 4, 5 needs to be only 20% or 10% larger than the spacing between the chute definitions 15, 16 at the most, resulting in very short movement paths of the stack 7 irrespective of to which exit conveyor 4, 5 the transfer is made.

The feed conveyor 3 comprises two conveying members mutually engaging each stack ply 6, namely an upper conveyor belt 31 and located immediately therebelow a supply support or conveyor belt 32 endlessly circulating around separate return pulleys 33, 34, 36 and defining by their runs from each other a clamping or conveying nip 35 for the shingled ply stream 6. The frontmost return pulley 33 of the upper belt 31 located nearest to the plane 11 is situated nearer to the plane 11 than the corresponding frontmost return pulley 34 of the lower belt 32 so that the upper belt 31 extends beyond the corresponding definition 16 or the chute 14, while the lower belt 32 extends only as far as the chute definition 16. Accordingly, the stack plies (6) exiting the conveying nip 35 in a trajectory curved downwards directly above the chute definition 16, are supported by the upper belt 31 against upward movements and gain access to the chute definition 15 in free flight until their leading sheet edges are stopped, their trailing sheet edges being simultaneously free of the conveying nip 35 so that the stack ply 6 is able to settle downwards as a whole.

The leading sheet edge of the stack ply 6 located above in each case is set back relative to that of the stack ply located therebelow so that it is always the lowermost stack ply 6 which first becomes totally free of the feed conveyor 3 and is able to settle downwards as a single sheet on the stack 7. In the meantime the support 8 and the definitions 15 to 18 are maintained continually vibrated, as a result of which the plies 6 settle spread out flat and congruental in the stack 7. The sheets 6 are oriented at all definitions 15 to 18. Each stack ply 6 may also be composed of several, e.g. at least four or five single sheets piled congruently or cross-cut in a common pile, thus forming a thin pack of sheets.

The stack support 8 and the arms 15, 27 or 16, 27 are non-destructively replaceable, as a result of which the stacker 1 can be converted to comply with differing formats or sizes of the stack plies 6. The arms 27 can be arranged infinitely longitudinally adjustable and lockable in place on the shafts 29. The chute definitions 17, 18 are likewise non-destructively replaceable and stand totally freely accessible on the upper side of the support 8, relative to which they are clamped in place by bolts or the like. For facilitated access to the components for replacement and to the chute 14 the feed conveyor 3 can be swivelled upwards so that it is located outside of the chute 14 as viewed from above. For this purpose the discharge end of the feed conveyor 3 is swivably mounted by a bearing 37 which may be situated in the axis of one of the return pulleys 36, namely for return of the lower belt 32. The swivelling direction is indicated by the arrow 38, whilst the feed direction is identified by the arrow 39. The upper definition of the conveying nip 35 formed by the upper belt 31 is located in the feed plane 13.

On completion of piling a stack 7 and prior to lowering the definition 15, further placement of stack plies 6 on the stack 7 is prevented by an auxiliary means 40, 40' this although the feed conveyor 3 continues running. The auxiliary means 40 comprise an auxiliary support 41, which could also be provided by belt 32, located continually spaced away above the stack 7 and thus not in contact therewith which is situated directly above the upper ends of the chute definitions 15, 16 and below the upper edges of the definitions 17, 18 spaced away lateral therefrom and between so that its support plane 46 is permanently located below or in center plane 13 and the upper edges of the walls 17, 18 but slightly above the upper ends of the definitions 15, 16. The auxiliary support and belt is situated, as viewed in the direction 24, 25, 39, namely at right angles to the planes 11,12, totally between the definition arms 15, 16 so that it could also be located below the upper ends thereof and moved over the chute 14.

Figure 3:
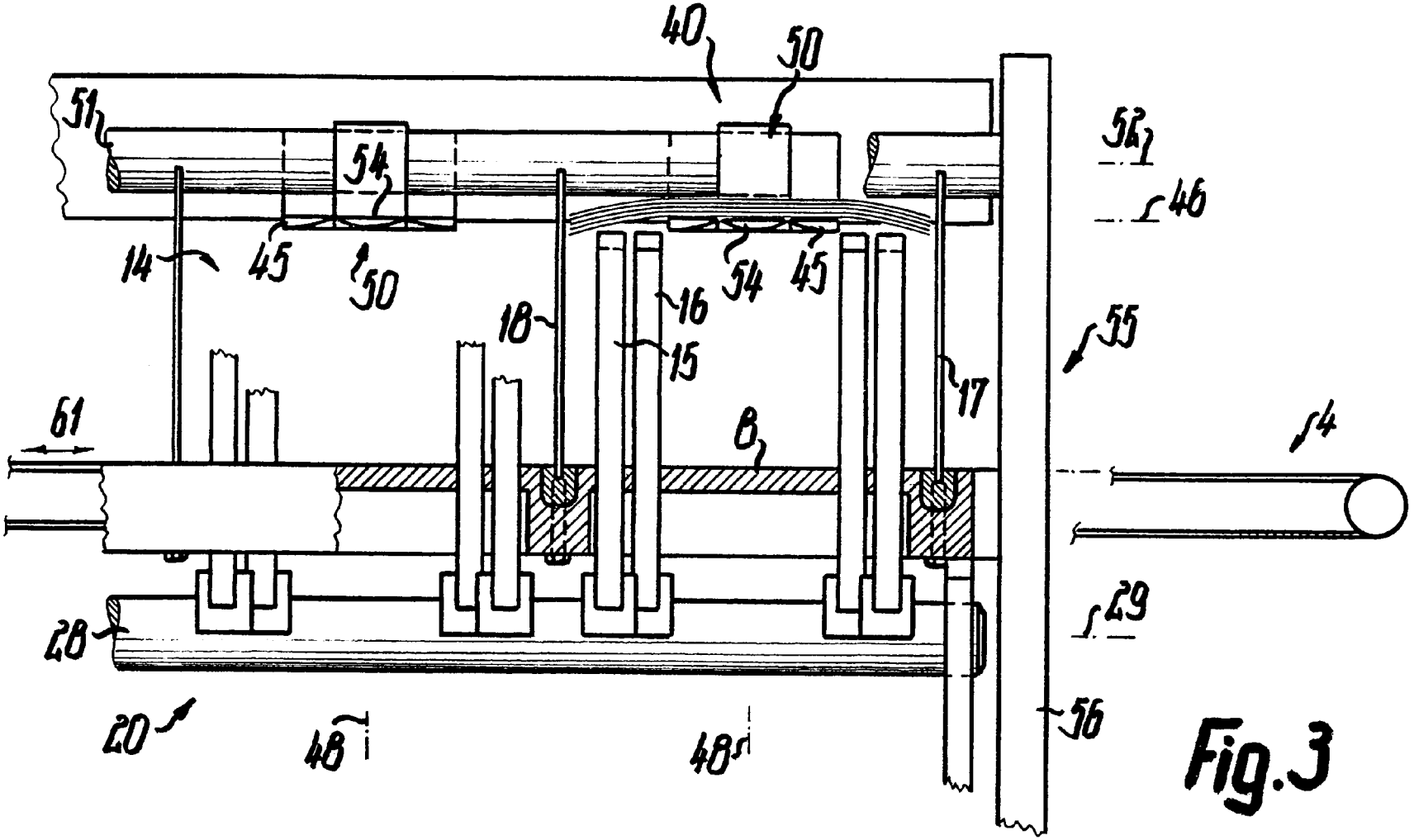
FIG. 3 is a view of the stacker as shown in FIG. 1 in a slightly modified configuration as viewed from the left.
Figure 4:
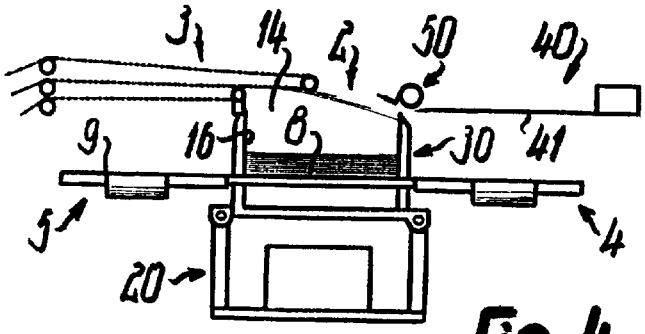
FIGS. 4 to 7 show the stacker as shown in FIGS. 1 to 3 in a slightly modified configuration and in a sequence of working situations.
Figure 5:
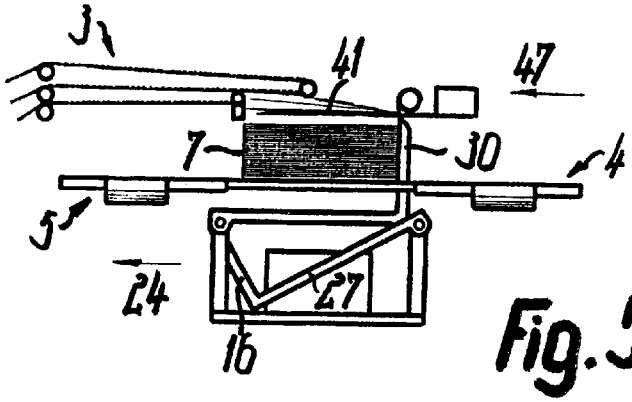
Figure 6:
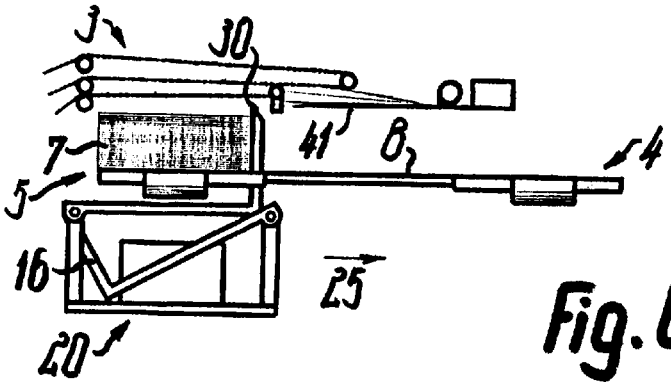
Figure 7:
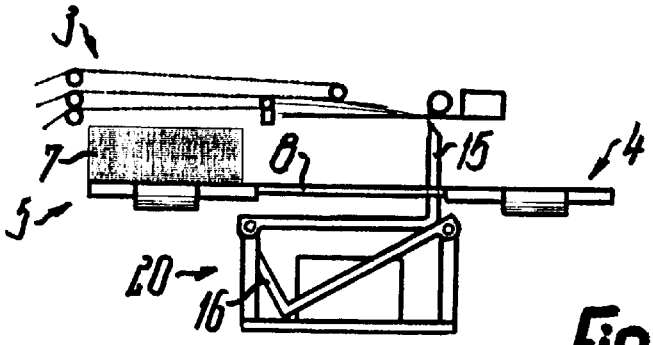

The auxiliary support 41 is transposable with a car or slider 42 from the starting position as shown in FIGS. 1 to 4 contrary to the direction 39 in the direction 47 linearly into the working position as shown in FIGS. 5 to 7 in which it is located above the chute 14 or the stack 7 and extends by its free end almost up to the plane of the chute definition 16. With the slider 42 a conveying member 43 is shiftable in and contrary to the direction 47 driven by a motor, the auxiliary support 41 being arranged on the conveying member 43 with a slider 44 infinitely adjustable parallel to the planes 10 to 13, i.e. at right angles to the directions 24, 25, 39, 47 and lockable in position, as a result of which each auxiliary support 41 can be precisely set, irrespective of all others, on the corresponding chute 14, even when a change is made to a differing format of the stack plies 6.

All auxiliary supports 41 for all chutes 14 are adjustable in common in the direction 47, e.g. by being arranged on a common conveying member 43, a configuration also being conceivable, however, in which the auxiliary support 41 is transposable into the working position and back into the resting position by a separate drive for each chute 14 irrespective of the others. Each auxiliary support 41 comprises only two rod-shaped forked arms 45 located spaced away adjacent to each other which are sharply pointed at their front ends, more particularly on the upper side and at the outer side flank. The auxiliary support 41 is expediently located symmetrically to the center plane 48 of the corresponding chute 14 situated at right angles to the planes 10 to 13, 46 and parallel to the directions 24, 25, 39, 47 as well as to the definitions 17, 18.

In addition to the mobile definition 15, 16 provided twice in each case, stationary definitions 49 are also provided which directly adjoin the upper ends of the definitions 15, 16 in the stack position as shown in FIG. 1 and are located in the plane of the corresponding definition 15 or 16 in each case. Each definition 49 may be formed by a component extending continually through all stations 2, such as a web, extending deeper than the upper ends of the angle legs 15, 16 and provided for each angle leg comb-like with a closely fitting passage in the form of an opening. As a result of this even the plies 6 arriving higher than the definitions 15, 16, e.g. on or at the auxiliary member 41, 41' are instantly correctly oriented at the definitions 49. Once the auxiliary support 41 has received plies 6, as shown in FIG. 3, and has been retracted again, these plies 6 come into contact by their edges with the definition 49 located nearby, this definition 49 retaining the plies 6 above the chute 14 as a sweeper so that the plies 6 can then drop into the chute 14 and onto the support 8, they thereby first sliding on the definitions 49 and then on the definitions 15, 16. The sweeper 49 is situated opposite the port of the feed conveyor 3.

Also located in the region of the last-mentioned definition 49 is a further support 54 for the margins of the plies 6 advancing from the feed conveyor 3. This support 54 may be formed by a sheet catcher 50 mounted to swivel between two end positions with a shaft 51 about an axis 52 located parallel to the planes 10 to 13, 46 and at right angles to the directions 24, 25, 39, 47. In moving from one end position to the other the sheet catcher 50 requires much less time and travel than the auxiliary support 41 for its movement from the resting position as shown in FIG. 1 into the working position as shown in FIGS. 5 to 7. The sheet catcher 50 comprises an angle arm having one leg situated transversely to the shaft 51 hanging adjoining thereto and located at right angles thereto as a supporting finger 54 directed at the feed conveyor 3 and sharply pointed as viewed from the side. In the resting position as shown in FIG. 1 the finger 54 juts slantingly upwards at an acute angle against the plane 13 and away from the plane 10, while in the working position as shown in FIGS. 3 and 5 to 7 it extends by its upper side up to the plane 46. The finger 54 is substantially shorter than the fork rods 45 and extends over less than a fifth of the spacing between the definitions 15, 16 beyond the corresponding definition 15.

The finger 54 is a close fit in the gap 53 between the support arms 45 so that these, despite their length, are well supported against side movements in sliding on the finger 54 without, however, having to engage the finger 54 in the resting position. In the working position the second or tangential leg of the sheet catcher 50 passing through the definition 49 in the region of a close-fitted gap forms a smooth continuation of the corresponding definition 15, 49. The shaft 51 carrying for each station 2 a catcher 50 is driven by a suitable control motor (not shown). Similar control motors, each operating separately, are also provided for driving the feed conveyor 3, each of the exit conveyors 4, the car 20, the reciprocating device 26, each of the shafts 28 and the auxiliary members 41, 41', 54, 54' whereby each pair of movements produced by these drives can be mechanically and/or electronically synchronized. The definition 49 located opposite the fingers 41, 54 may tangentially adjoin the front side of the return pulley 34. All members 41, 41', 54 are infinitely adjustable in common or independently of each other parallel to the planes 10 to 13, 46, e.g. on the member 43 or on the shaft 51.

While continuously running in conveyor 3 sheets 6 can be stopped before reaching roller 34 by abutting on stop 41' with their leading edges directly adjacent to roll 34. Stop 41' projects over one leg of an angular lever 42' perpendicular to plane 13 when in abutment position according to FIG. 1*a*. The other leg is fixed to connecting head 44' and positively drivable to pivot common with transverse shaft 43'. Stop 41' passes between juxtaposed conveying sections of belt 31. Then the lower edge face almost slides on the upper face of the scaly layer stream and locks the next following as well as all further sheets while the still underengaging sheets are further moved onto stack 7. Therefore all following sheets are shifted onto each other at rail 41' to collect to a flat stack while carriage 20 conveys a stack 7 to conveyor 9. To release the flat stack rail 41' is pivoted upwards. Stop 41' is contiunuously displaceable and lockable transverse to plane 13 and relative to body 42'. When support 8 is returned to stacking position stop 41' is removed out of the path of the meanwhile formed flat stack. Therefore by being pressed between running belts 31, 32 the flat stack is directly thrown onto support 8. Roll 33 can reach at least or almost up to the center between bounds 15, 16 and can be positioned lower than roll 34, thereby belt 31 being downwardly deflected at an obtuse angle under pressure on roll 34 or belt 32. Over the same conveying width belt 32 includes more individual belts juxtaposed with gaps than belt 31 does. Comb 41' passes through the gaps of belt 31, the individual stop finger being either located between two belts 32 or on a belt 32.

Means 50' located upstream of stop 41' and directly behind the flat stack to be formed are provided for transversely expanding belts 31, 32. Thereby a taper gap 35' continually closed toward deflection 34 or a deflection located upstream thereof is formed. In this chamber 35' sheets 6 are collected while being superimposed and while widening gap 35'. Expanding device 50' includes two juxtaposed deflections 54' and a further deflection 51' whereover belt 32 runs one after the other. Rolls 54' commonly with opposing sections of belt 32 close the widened end of gap 35' in the expanding position according to FIG. 1*a*. Rolls 51', 54' are supported on a common carrier pivotable by motor drive and electronical control about a transverse axis oriented parallel to plane 13. Gap 35' is opened simultaneously with electronically controlled lowering of stop 41' into abutment position.

When finishing precollection by lifting stop 41' roller carrier pivots back to normal position in which rolls 54' oriented parallel to belt 31 and gap 35' has its minimum width. The falling height for the sheets is variable by choosing differnt pivot angles of the roller carrier. The roller carrier is displaceable in directions 39, 47 for continuously varying the length of gap 35' to be equal with varying sheet formats having a length up to 70 cm. Pivot axis of roller carrier can be the axis of each of rolls 54' or be located between rolls 54', depending from whether in the expanding position the upstream roll 54' should be lifted toward or even common with belt 31 or not.

All movable parts of the device are arranged on a base 55, e.g. a device frame comprising side cheeks 56 to which the reciprocating device 26, the return pulleys 36, the mount 37, the rails for the slider 42, 43 and the shaft 51 are mounted or secured. The rails of the slider 52 and the bearings for the shaft 51 may be mounted on the base 55 movable into a servicing position in which they are located further removed from the station 2 and the underside of the corresponding exit conveyor 4. For instance, this servicing position may be displaced outwards to the right contrary to direction 47 as shown in FIG. 1. In the working position the means 40, 50 are located spaced away above the exit conveyor 4 while the feed conveyor 3 is located at roughly the same spacing away above the feed conveyor 5. In no position is the finger 54 in contact with the top of the stack 7. The table 8 can be secured to the cheeks 56 to permit vibration and cover all stations 2 in one piece. Its vibratory movements are also directly transferred to the definitions 17, 18. The conveyors 4, 5 conveying transversely to the side cheeks 56 pass through the side cheeks in the region of separate passage windows. Each conveyor 4 or 5 extends far beyond both outer sides of the frame 55, 56 and conveys optionally in opposing directions parallel to the planes 10 to 13, 46 or at right angles to the directions 24, 25, 39, 47.

Figure 2:
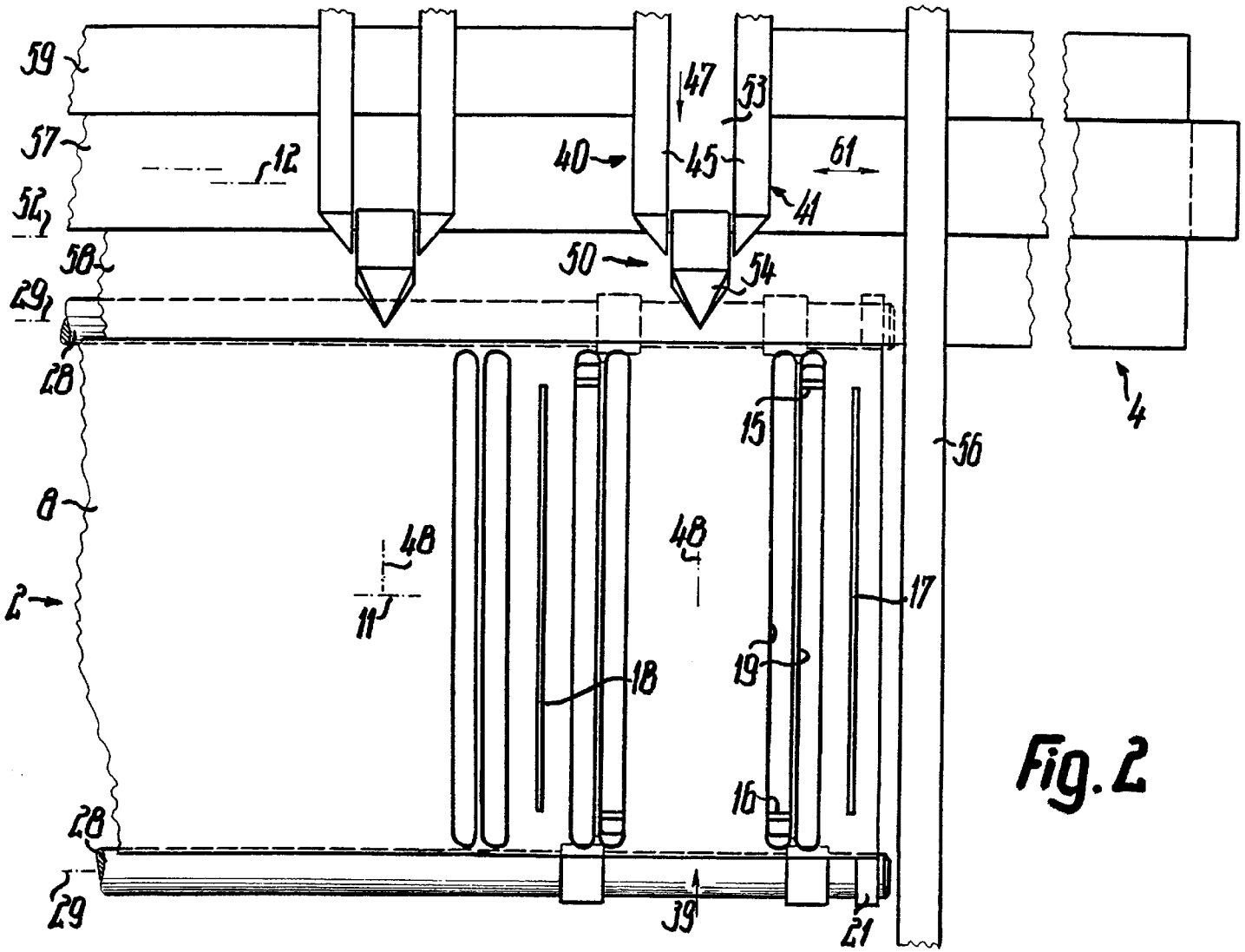
FIG. 2 is a plan view of the stacker as shown in FIG. 1 in a slightly modified configuration.

Spaced away in the middle between its longitudinal edges each conveyor 4 or 5 comprises a circulating conveyor belt 57 the longitudinal center plane of which as shown in FIGS. 1 and 4 to 7 coincides with the corresponding plane 12 or as shown in FIG. 2 relative to which it may be located symmetrically further remote from the station 2. Sliding tables 58, 59 directly adjoin the upper run of the powered conveyor belt 57 on both sides, these tables like the conveyor belt 57 being configured perforated and connected independently of each other to suction and pressure means, namely pneumatic supply conduits via control means, such as valves. Due to this arrangement, in the region of the single supports 57 to 59 each independent of the other, the bottom of the stack 7 can be suctioned or urged upwards by an air cushion. As shown in FIG. 1 the table 8 is rendered wider towards the conveyor 4 so that the table 8 forms the sliding table 56 located nearer thereto over part of its width and this part can be replaced with the table 8, while the further part directly adjoining conveyor 57 remains unchanged in position.

The stacker device 1 operates as follows:

As shown in FIGS. 1 and 4 chute 14 and boundaries 15, 16 are in the stacking position in which the auxiliary support 41 is retracted and the catcher supports 54 are set oriented slantingly upwards. The feed conveyor 3 feeds one stack ply 6 after the other to the support 8 or to the top of the stack 7 so that the latter never attains the upper ends of the definitions 15 to 18. As soon as the desired stacking height is attained, the catcher support 54 swivels by less than 90° or 45° downwards while at the same time the movement of the auxiliary support 41 begins and continues in the direction 47 until the auxiliary support has almost reached the opposite definition 16, 49. The further fed stack plies 6 are now deposited on the auxiliary support 41, 54. Thus, depending on the shifting direction 24 or 25 chosen, the frontal definition 15 or 16 can be lowered about the axis 29 from the moment the first stack ply 6 has been caught by the catcher finger 54 above the stack 7. As soon as, as shown in FIG. 1 for example, this definition 15 is freed from the table 8 below thereof, the shifting movement of the car 20 in the direction 25 commences, the slider 16, 30 entraining the stack 7 and shifting it along the stationarily remaining definitions 17, 18 toward plane 12 of the conveyor 4. In this action the coplanar table surfaces 57 to 59 are pulsed with compressed air so that the stack 7 is transferred practically with zero sliding friction into its exit position in which it is located symmetrically to the plane 12.

The conveyor belt 57 is then changed over to suction so that the bottom of the stack 7 firmly sticks to it whilst the two table surface areas 58, 59 continue to be controlled with compressed air to minimize the sliding friction. The conveyor belt 57 is then powered in one of the two directions 61, as a result of which the stack 7 is transported away from the device 1. As soon as the exit position is attained the car 20 commences in direction 24 its opposite return motion to the stacking position which when attained causes the definition 15 in turn to commence swivelling upwards into the shaft position. Throughout the complete movement sequence as described the plies 6 continue to be fed at a steady speed to the auxiliary support 41, 54.

As soon as the definition 15 has attained its shaft position the auxiliary support 41 initially commences retraction so that the stack plies 6 settle under their own weight on the support 8 firstly at the definition 16 and lastly at the definition 15. At the same time the finger 54 is again swivelled upwards, the corresponding margins of the ply 6 curving to slide downwards beyond the free end of the finger 54. As shown in FIG. 3 the auxiliary support 45, 54 is so narrow that the stack plies 6 hang slantingly downwards by their margins oriented against the definitions 17, 18 at an acute angle relative to the plane 46, as a result of which no-problem settling on the support 6 is facilitated.

In uninterrupted continuation the shaft 14 is then refilled as shown in FIG. 4, until the stack 7 has again attained the desired height, as of which the auxiliary device 40 can in turn be transposed into its catching position in the way as already described and this time the other definition 16 can be lowered so that the definition 15 as the pusher 30 transfers the stack 7 in the direction 24 onto the conveyor 5, as shown in FIG. 5, the individual sequences being controllable the same as described before relative to the conveyor 4. From the transfer position for the conveyor 5, as shown in FIG. 6, the definitions 15, 16 are then returned in the opposite direction 25 into the stacking position as shown in FIG. 7, after which the definition 16 is lifted into the chute position, the means 40 translated into the resting position and the stack plies 6 again deposited on support 8. In this arrangement the stack always remains out of contact relative to the definitions 49. All of the movement sequences described are automatically rendered compatible with each other by the cited control means. The movement sequences are very simple and can be the same irrespective of the formats of the stack plies 6. Expediently the sheet catcher 50 or the shaft 51 is infinitely adjustable at right angles transversely to the planes 10 to 13, 46 to permit piling stacks 7 differing in height without having to change the level of the table 8 or exit conveyor 4, 5.

As shown in FIGS. 4 to 7 the conveyor 5, which like the conveyor 4 as shown in FIG. 1 may also be provided alone, is located spaced away below the belts 31, 32 of the conveyor 3 which conveys to deflection pulleys 36 from a lower-lying level slantingly upwards before then conveying full-length in the direction 39 up to the port. This is why conveyor 5 is located, in side view, within an angle zone of the conveying sections of the conveyor 3 which adjoin at pulleys 36 at an obtuse angle. The table 8 too, may be provided perforated as already described relative to the supports 57 to 59 and connected to a source of compressed air to minimize sliding friction in shifting the stack 7.

It will be appreciated that all properties and effects may be provided precisely or merely approximately or substantially as described or they may also greatly depart therefrom, depending on the requirements made on the device. Furthermore, the exit conveyors, more particularly their conveyor belts 57, may be separated into single belts capable of being longitudinally arranged in a chain, driven separately and independently of each other and adjoin each other e.g. with their opposing ends in the region of one or more of the stations 2 or planes 48 or definitions 16 so that stacks 7 transferred simultaneously from the chutes 14 can be simultaneously exited in opposite directions 61. Adjacent stacks gain access to the exit conveyor 4 or 5 while being spaced from each other by a spacing corresponding to the minor thickness of the sheet metal walls 18 which are planar throughout. Therefor all stacks 7 from all shafts 14 can be delivered with this spacing as a train by the conveyor 4 or 5.

What is claimed is:

1. A stacker for producing stacks having a stack height of stack layers, comprising:

a stationarily supported base;

a stacking station supported by said base;

layer supports including:

a stack support located at said stacking station for receiving in a stacking position the stack layers piled in sequence for forming the stack over the stack height with the stack layers being in direct mutual contact, and a removal support;

a conveying member, said conveying member including a pusher for pushing the stack positioned in said stacking position from said stack support;

a lateral stack boundary (15) opposing said pusher, said lateral stack boundary contacting the stack remote from said pusher and substantially over the stack height when the stack layers are piled onto said stack support;

a transfer conveyor for removing the stack with said conveying member over a transfer path from said stacking station to said removal support in a transfer direction, and a removal conveyor including said removal support and defining a removal direction, said removal direction oriented transverse to said transfer direction, said stack support and said removal support defining at least one support plane.

2. The stacker according to claim 1, wherein said lateral stack boundary includes a first stack boundary and a second stack boundary opposing said first stack boundary, said first and second stack boundaries protruding beyond said support plane of said stack support when in said stacking position, both said first and second stack boundaries engaging the stack layers while being piled, said stack boundary including said pusher, said pusher being opposed by said first stack boundary.

3. The stacker according to claim 2, wherein said first stack boundary is operationally transferable out of said transfer path into a release position to thereby retract said first stack boundary from the stack while the stack remains stationary, while said pusher pushes the stack said first stack boundary commonly and synchronously displacing with said pusher.

4. The stacker according to claim 3, wherein when said first stack boundary is in said release position said second stack boundary includes said pusher and said first stack boundary is located below said support plane of said layer support.

5. The stacker according to claim 1, wherein said stack support is permanently positioned level with said removal support, said pusher being displaceably mounted on said base exclusively below said stack support, said pusher passing through said support plane in said stacking position, while the pusher pushes the stack said lateral stack boundary and said pusher being commonly displaced in said transfer direction.

6. The stacker according to claim 1, wherein while in said stacking position said lateral stack boundary and said pusher is displaceable transverse to and with respect to said support plane, thereby said lateral stack boundary and said pusher lifting off of the stack simultaneously over the stack height.

7. The stacker according to claim 1, wherein said layer supports further include an auxiliary support and a supply support for supplying the stack layers on the stack and on said auxiliary support transversely spaced from the stack piled on said stack support, said auxiliary support being linearly displaceable parallel to a feed direction for optionally covering and uncovering the stack, said feed direction being substantially parallel to said transfer direction.

8. The stacker according to claim 7, wherein in a view transverse to said support plane said auxiliary support is narrower than said stack support with respect to a direction oriented transverse to said transfer direction and parallel to said support plane.

9. The stacker according to claim 7 and further including a feed conveyor including said supply support and a feed member commonly displaced with the stack layers while being piled onto the stack, wherein said auxiliary support is displaceable below said feed member, thereby said feed member covering and directly piling the stack layers onto said auxiliary support.

10. The stacker according to claim 1 and further including a layer catcher for positionally orienting the stack layers prior to being disposed on said stack support, wherein said layer supports and said layer catcher include a catch support located spacedly above the stack (7) deposited on said stack support and abutting the stack layers when supplied to cover said stack support and when said layer catcher is in a catch position, said layer catcher being located above and spaced from said lateral stack boundary.

11. The stacker according to claim 10, wherein said layer catcher is operationally displaceable out of said catch position, thereby optionally either said lateral stack boundary or said layer catcher receiving and orienting the stack layers.

12. The stacker according to claim 7 and further including a layer catcher for positionally orienting the stack layers while being deposited on said auxiliary support, wherein said auxiliary support is displaceable with respect to said layer catcher.

13. The stacker according to claim 1, wherein said removal support is continuously adjustable transverse to said transfer direction and positionally lockable relative to said base.

14. The stacker according to claim 1, wherein a vibrator is provided for vibrating at least one of said stack support and said conveying member.

15. The stacker according to claim 1 and further including a piling shaft for positionally orienting the stack layers and the stack when deposited on said stack support, wherein said piling shaft includes said lateral stack boundary and first and second side boundaries oriented transverse to said lateral stack boundary for circumferentially bounding the stack said lateral stack boundary being displaceable along a bounding face of at least one of said side boundaries, said pusher including two pusher arms displaceable between said first and second side boundaries.

16. The stacker according to claim 1, wherein said stacking station includes a plurality of separate and juxtaposed individual stacking places for simultaneously piling a plurality of the stacks, two of said stacking places being separated by a common side boundary positionally orienting the stack layer and the stacks with remote boundary faces, said common side boundary including a thin plate extending over the stack height and aligning the stack while being pushed toward the removal support.

17. The stacker according to claim 1, wherein at least one of said stack support and said removal support includes at least one of means for air cushioned support of the stack layer, and suction means for adhering the stack layers toward said support plane.

18. A stacker for producing stacks of stack layers, comprising:

a stationarily support base;

a stacking station support by said base;

layer supports including:

a stack support located at said stacking station for receiving in a stacking position the stack layers piled in sequence for forming the stack, and a removal support;

a conveying member, said conveying member including a pusher for pushing the stack positioned in said stacking position form said stack support;

a transfer conveyor for removing the stack with said conveying member over a transfer path from said stacking station to said removal support in a transfer direction; and a removal conveyor including said removal support and defining a removal direction, said removal direction oriented transverse to said transfer direction, said stack support and said removal support defining at least one support plane for pushing the stack from said stack when positioned in said stacking position, wherein said at least one support plane of said stack support and said removal support are firmly interconnected, said pusher being transversely adjustable relative to said at least one support plane, said pusher being pivotable from a release position into said stacking position through an angle of less then 85° to 45°.

19. A stacker for producing stacks of stack layers, comprising:

a stationarily support base;

a stacking station support by said base;

layer supports including:

a stack support located at said stacking station for receiving in a stacking position the stack layers piled in sequence for forming the stack, and a removal support;

a conveying member, said conveying member including a pusher for pushing the stack positioned in said stacking position form said stack support;

a transfer conveyor for removing the stack with said conveying member over a transfer path from said stacking station to said removal support in a transfer direction; and a removal conveyor including said removal support and defining a removal direction, said removal direction oriented transverse to said transfer direction, said stack support and said removal support defining at least one support plane for pushing the stack from said stack support when positioned in said stacking position, said stack support located between said removal conveyor and a second removal conveyor, said conveying member including separate and opposed first and second conveying members for optionally transferring said stack to each of said removal conveyor and said second removal conveyor.

20. A stacker for producing stacks of stack layers, comprising:

a stationarily support base;

a stacking station support by said base;

layer supports including:

a stack support located at said stacking station for receiving in a stacking position the stack layers piled in sequence for forming the stack, and a removal support;

a conveying member, said conveying member including a pusher for pushing the stack positioned in said stacking position form said stack support;

a transfer conveyor for removing the stack with said conveying member over a transfer path from said stacking station to said removal support in a transfer direction;

a removal conveyor including said removal support and defining a removal direction, said removal direction oriented transverse to said transfer direction, said stack support and said removal support defining at least one support plane for pushing the stack from said stack support when positioned in said stacking position;

a lateral stack boundary protruding beyond said support plane of said stack support when in said stacking position, said lateral stack boundary engaging the stack layers while being piled, said lateral stack boundary including said pusher, and wherein said stack boundary includes opposing stack boundaries for engaging remote sides of the stack, at least one of said opposing stack boundaries being operationally transferable out of said transfer path into a release position; and, a transfer slide bearing said opposing stack boundaries displaceable in and counter to said transfer direction while at least one of said opposing stack boundaries is in said stacking position, at least one of said stack boundaries being operationally displaceable behind said support plane and out of said stacking position while the stack is in said stacking position.

21. A stacker for producing stacks of stack layers, comprising:

a stationarily support base;

a stacking station support by said base;

layer supports including:

a stack support located at said stacking station for receiving in a stacking Position the stack layers piled in sequence for forming the stack, a removal support, and an auxiliary support and a supply support for supplying the stack layers on the stack, said auxiliary support transversely spaced from said stack support, said auxiliary support being linearly displaceable parallel to a feed direction for optionally covering and uncovering said stack support;

a conveying member, said conveying member including a pusher for pushing the stack positioned in said stacking position form said stack support;

a transfer conveyor for removing the stack with said conveying member over a transfer path from said stacking station to said removal support in a transfer direction; and a removal conveyor including said removal support and defining a removal direction, said removal direction oriented transverse to said transfer direction, said stack support and said removal support defining at least one support plane for pushing the stack from said stack support when positioned in said stacking position, a layer catcher for positionally orienting the stack layers while being deposited on said auxiliary support, said auxiliary support being displaceable with respect to said layer catcher, and wherein at least one of said auxiliary support and said layer catcher includes a gap, said auxiliary support and said layer catcher defining first and second orienting members, said first orienting member including said gap for displaceably receiving said second orienting member.

22. A stacker for producing stacks of stack layers, comprising:

a stationarily supported base;

a stacking station supported by said base;

layer supports including:

a stack support located at said stacking station for receiving in a stacking position the stack layers piled in sequence for forming the stack, and a supply support for supplying the stack layers on the stack in a supply direction; and, a layer guide freely projecting over the stack when located in said stacking station to prevent the stack layers from being lifted away from said stack support while arriving in said stacking station directly from said supply support, wherein said layer guide freely projects in said supply direction and over said supply support.

23. The stacker according to claim 22, wherein said layer guide includes a guide member operationally contacting the stack layers and commonly displaceable with the stack layers in said supply direction while freely opposing the stack.

24. The stacker according to claim 22, wherein said layer supports further comprises an auxiliary support freely projecting counter to said supply direction, said auxiliary support opposing said layer guide in said supply direction, when forwarded said auxiliary support opposing said layer guide transverse to said supply direction and directly receiving the stack layers while the stack layers transversely move away from said layer guide.

25. A stacker for producing stacks of stack layers, comprising:

a stationarily supported base;

a stacking station supported by said base;

layer supports including:

a stack support located at said stacking station for receiving in a stacking position the stack layers piled in sequence for forming the stack, and an auxiliary support for receiving the stack layers spacedly above said stack support while the stack is removed from said stacking station; and, a layer catcher for positively orienting the stack layers while being deposited on said auxiliary support, said auxiliary support and said layer catcher operationally nested by interengaging at least one gap, said auxiliary support being displaceable spacedly over the stack and independent from said layer catcher.

26. A stacker for producing stacks of stack layers, comprising:

a stationarily supported base;

a stacking station supported by said base;

layer supports including:

a stack support located at said stacking station for receiving in a stacking position the stack layers piled in sequence for forming the stack, and a removal support;

a conveying member;

a transfer conveyor for removing the stack with said conveying member over a transfer path from said stacking station to said removal support in a transfer direction; and, means for commonly and continuously displacing said stack support and said removal support transverse to a support plane of said stack support and said removal support with respect to said base.

27. A stacker for producing stacks of stack layers, comprising:

a stationarily supported base;

a stacking station supported by said base;

layer supports including:

a stack support located at said stacking station for receiving in a stacking position the stack layers piled in sequence for forming the stack, and a removal support;

a conveying member;

a transfer conveyor for removing the stack with said conveying member over a transfer path from said stacking station to said removal support in a transfer direction; and, a vibrator for vibrating at least one of said conveying member while contacting the stack and said layer support.

28. A stacker for producing stacks of stack layers, comprising:

a stationarily supported base;

a stacking station supported by said base;

layer supports including a stack support located at said stacking station for receiving in a stacking position the stack layers piled in sequence for forming the stack, feed conveyor including a feed outlet for supplying the stack layers directly onto the stack, upstream of said feed outlet said feed conveyor bounding a feeding gap filled with the sheet layers while being supplied, said feed conveyor including at least one feed member bounding said feeding gap and simultaneously driving the stack layers towards said feed outlet by being displaced towards said feed outlet, wherein said feeding gap is widenable to receive the stack layers while being accumulated within said feeding gap by being stopped downstream of said feeding gap and while said at least one feed member continues to be displaced toward said feed outlet.

29. The stacker according to claim 28, further comprising control means for positively widening said feeding gap independent from the stack layers and for switching a layer stop between released and activated positions, when in said activated position the stack layers accumulating within said feeding gap while being stopped by said layer stop at a downstream end of said feeding gap and while said feeding gap is angularly widened.

* * * * *